US006255994B1

(12) United States Patent
Saito

(10) Patent No.: US 6,255,994 B1
(45) Date of Patent: Jul. 3, 2001

(54) INVERTED-F ANTENNA AND RADIO COMMUNICATION SYSTEM EQUIPPED THEREWITH

(75) Inventor: Tetsuya Saito, Saitama (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/406,705

(22) Filed: Sep. 28, 1999

(30) Foreign Application Priority Data

Sep. 30, 1998 (JP) ..... 10-277874

(51) Int. Cl.[7] ..... H01Q 1/38

(52) U.S. Cl. ..... 343/700 MS; 343/702; 343/846

(58) Field of Search ..... 343/700 MS, 702, 343/829, 846, 848; H01Q 1/38

(56) References Cited

U.S. PATENT DOCUMENTS 5,585,810 * 12/1996 Tsuru et al. ..... 343/745
6,034,636 * 3/2000 Saitoh ..... 343/700 MS

FOREIGN PATENT DOCUMENTS 2 316 540 2/1998 (GB) .
62-188504 8/1987 (JP) .
406188630 * 7/1994 (JP) ..... H01Q/23/00
408250917 * 9/1996 (JP) ..... H01Q/1/24
8-321716 12/1996 (JP) .
9-307344 11/1997 (JP) .
10-28013 1/1998 (JP) .
10-065437 3/1998 (JP) .
10-65437 3/1998 (JP) .
10-190345 7/1998 (JP) .

* cited by examiner

*Primary Examiner*—Don Wong
*Assistant Examiner*—Shih-Chao Chen
(74) *Attorney, Agent, or Firm*—Sughrue, Mion, Zinn, Macpeak & Seas, PLLC

(57) ABSTRACT

An inverted-F antenna is provide, which is capable of coping with the change of available frequency bands while keeping its compactness. This antenna is comprised of a radiating element for radiating or receiving an RF signal, a ground conductor arranged to be opposite to the radiating element with a specific gap, a feeding terminal electrically connected to the radiating element, a first grounding terminal electrically connected to the radiating element, at least one impedance element provided in a line connecting the first grounding terminal to the ground conductor, and a first switch for selectively inserting the at least one impedance element into the line. A resonant frequency of the antenna is changed by operating the first switch. As the at least one impedance element, an inductance or capacitance element is used. Preferably, a second grounding terminal electrically connected to the radiating element through a second switch is further provided.

11 Claims, 12 Drawing Sheets

INVERTED-F ANTENNA AND RADIO COMMUNICATION SYSTEM EQUIPPED THEREWITH

BACKGROUND OF THE INVENTION

1. Field of the Invention

The present invention relates to an inverted-F antenna and a radio communication system equipped with the antenna and more particularly, to an inverted-F antenna capable of operation in separate frequency bands or a wide frequency band formed by overlapping separate frequency bands, and a radio communication system necessitating the switching of its operating frequency band, such as a digital portable or mobile telephone.

2. Description of the Prior Art

In general, mobile radio communication systems such as cellular phones exchange communications or messages by using one of assigned frequency bands.

In recent years, as the popularity of cellular phones has explosively grown, the exchange of communications or messages has become difficult to be performed by using a single specified frequency band. To cope with this situation, cellular phones tend to be equipped with a function enabling the communication/message exchange using separate frequency bands or a single wider frequency band.

Conventionally, an inverted-F antenna has been widely used as a receiving antenna of a cellular phone, because it can be formed compact. However, an inverted-F antenna has a disadvantage that the operable frequency band is comparatively narrow. Therefore, various techniques have been developed to make it possible for an inverted-F antenna to cover separate frequency bands or a wider frequency band.

For example, the Japanese Non-Examined Patent Publication No. 10-65437 published in March 1998 discloses an improvement of an inverted-F antenna, which was invented by the inventor of the present invention, T, Saito. This improved antenna is shown in FIGS. 1 to 3.

As shown in FIG. 1, the prior-art inverted-F antenna 110 is comprised of a rectangular conductor plate 100 serving as a radiating element, a circuit board 106 serving as a ground conductor, and a dielectric spacer 107 placed between the plate 100 and the board 106. The spacer 107 serves to fix the distance between the conductor plate 100 and the circuit board 106 at a specific value, thereby stabilizing the radiating characteristics of the antenna 110. The long-side length of the conductor plate 100 is La and the short-side length thereof is Lb.

The conductor plate or radiating element 100 has a feeding terminal 102 for feeding a Radio-Frequency (RF) electric signal to the element 100 or receiving a RF electric signal therefrom, a grounding terminal 103 for grounding he element 100 to the board or ground conductor 106, and a switching terminal 104 for switching the resonant frequency of the antenna 110. The radiating element 100 and the terminals 102, 103, and 104 are formed by a conductor plate. The terminals 102, 103, and 104 are L-shaped and connected to a short-side of the rectangular radiating element 100. The pitch between the terminals 102 and 103 is Lc. The pitch between the terminals 103 and 104 is Ld.

The lower part of the feeding terminal 102, which is bent to be parallel to the circuit board 106, is separated from the board 106 by a rectangular hole 106*a* penetrating the board 106. Therefore, the feeding terminal 102 is not electrically connected to the board 106. The lower part of the terminal 102 is electrically connected to a receiver circuit 108 in a radio section 120 of a cellular phone, as shown in FIG. 2.

The lower part of the grounding terminal 103, which is bent to be parallel to the circuit board 106, is contacted with and electrically connected to the board 106. The lower part is fixed to the board 106 by soldering. Thus, the terminal 103 is electrically connected to the ground.

The lower end of the switching terminal 104, which is bent to be parallel to the circuit board 106, is separated from the circuit board 106 by a rectangular hole 106*b* penetrating the board 106. The lower end of the terminal 104 is electrically connected to one terminal of a switch 105 located in the hole 106*b*. The other terminal of the switch 105 is electrically connected to the board 106.

The switch 105 is controlled by a controller circuit 109 in the radio section 120 of the cellular phone, as shown in FIG. 2. If the switch 105 is turned off, the switching terminal 104 is electrically disconnected from the circuit board 106, in which only the grounding terminal 103 is electrically connected to the board 106. If the switch 105 is turned on, the switching terminal 104 is electrically connected to the circuit board 106, in which not only the grounding terminal 103 but also the switching terminal 104 are electrically connected to the board 106.

When the switch 105 is in the OFF state, the perimeter L of the rectangular radiating element 100 is given as $$L=(2La+2Lb).$$

In this case, as shown in FIG. 3, the VSWR (Voltage Standing-Wave Ratio) is minimized at a frequency f1. In other words, the resonant frequency of the antenna 110 is f1.

On the other hand, when the switch 105 is in the ON state, the equivalent electric length L' of the rectangular radiating element 100 is given as $$L'=(2La+2Lb-Ld).$$

In this case, as shown in FIG. 3, the VSWR is minimized at a frequency f2 higher than f1. In other words, the resonant frequency of the antenna 110 is switched from f1 to f2.

Thus, the resonant frequency of the prior-art antenna 110 can be changed between f1 and f2 and accordingly, the cellular phone having the antenna 110 is capable of covering two separate frequency bands or a wide frequency band formed by overlapping the two separate frequency bands.

Although not shown here, the Japanese Non-Examined Patent Publication No. 62-188504 published in August 1987 discloses a patch antenna comprising two relatively-movable radiating elements in addition to a ground plate. An RF signal is fed to the ground plate by a coaxial feeding line. The two radiating elements can be overlapped and contacted with each other, thereby changing the total volume or dimension of the radiating elements. Thus, the resonant frequency of the prior-art patch antenna disclosed in the Japanese Non-Examined Patent Publication No. 62-188504 can be changed, thereby covering two separate frequency bands or a wide frequency band formed by overlapping the two separate frequency bands.

Recently, there arises a problem that the available frequencies assigned to cellular phones tend to be short due to the increased traffic. To solve this problem, a consideration that new frequency bands are assigned to cell phones in addition to the conventional assigned frequency bands has been made, thereby relaxing or decreasing the congestion.

To cope with this consideration, the above-described prior-art antennas have the following problems.

With the prior-art antenna disclosed in the Japanese Non-Examined Patent Publication No. 10-65437, the resonant frequency is changed by connecting or disconnecting electrically the switching terminal 104 to or from the circuit board 106. Therefore, to cope with a newly-assigned frequency band, another switching terminal needs to be provided to the radiating element 100. However, the addition of the switching terminal is not always possible.

For example, if a newly-assigned frequency band (e.g., 830 MHz-band or near) is located between the two conventionally-available frequency bands (e.g., 820 MHz- and 880 MHz-bands) and near one of these two frequency bands, a newly-added switching terminal needs to be provided between the grounding terminal 103 and the switching terminal 104 and at the same time, it needs to be located near one of the terminals 103 and 104. However, some specific limit exists in fabricating actually the prior-art antenna 110 with the detachable ground terminals. As a result, the prior-art antenna 110 is difficult to cope with the addition of a newly-assigned frequency band.

Also, in recent years, cellular phones have been becoming more compact and more lightweight. Addition of a new grounding terminal to the radiating element 100 enlarges the size of the antenna 110 and the cellular phone itself. Thus, it is difficult to ensure the distance or pitch between the newly-added grounding terminal and a nearer one of the grounding terminals 104 and 105.

Moreover, the newly-added ground terminal necessitates a new land for its electrical connection on the circuit board 106, which requires more labor. The formation itself of the new land is difficult, because patterned circuits have been closely arranged on the board 106.

With the prior-art patch antenna disclosed in the Japanese Non-Examined Patent Publication No. 62-188504, there is a problem that the volume of the antenna is unable to be utilize effectively because this antenna has two movable radiating elements.

SUMMARY OF THE INVENTION

Accordingly, an object of the present invention to provide an inverted-F antenna capable of coping with the change or addition of available frequency bands while keeping its compactness, and a radio communication system using the antenna.

Another object of the present: invention to provide an inverted-F antenna whose operating frequency band can be optionally switched at a narrow interval or intervals, and a radio communication system using the antenna.

Still another object of the present invention to provide an inverted-F antenna that makes it possible to utilize effectively the antenna volume, and a radio communication system using the antenna.

A further object of the present invention to provide an inverted-F antenna that covers separate frequency bands or a wide frequency band formed by overlapping separate frequency bands, and a radio communication system using the antenna.

The above objects together with others not specifically mentioned will become clear to those skilled in the art from the following description.

According to a first aspect of the present invention, an inverted-F antenna is provided, which is comprised of a radiating element for radiating or receiving an RF signal, a ground conductor arranged to be opposite to the radiating element with a specific gap, a feeding terminal electrically connected to the radiating element, a first grounding terminal electrically connected to the radiating element, at least one impedance element provided in a line connecting the first grounding terminal to the ground conductor, and a first switch for selectively inserting the at least one impedance element into the line. A resonant frequency of the antenna is changed by operating the first switch.

With the inverted-F antenna according to the first aspect of the present invention, the at least one impedance element is provided in the line connecting the first grounding terminal to the ground conductor and at the same time, it is selectively inserted into the line by operating the first switch. Thus, the resonant frequency of the antenna can be changed by operating the first switch.

On the other hand, since the resonant frequency is changed by using the at least one impedance element and the first switch, another grounding terminal for electrically connecting the radiating element to the ground conductor is unnecessary in order to cope with the change of available frequency bands. This means that the change of available frequency bands can be realized without increasing the size of the antenna.

As a result, the antenna according to the first aspect of the present invention is capable of coping with the change of available frequency bands while keeping its compactness.

Also, the resonant frequency can be adjusted easily within a narrow range by adjusting the impedance value of the at least one impedance element. Thus, the operating frequency band of the antenna the antenna according to the first aspect can be optionally switched at a narrow interval or intervals.

Moreover, because the resonant frequency is changed by operating the first switch, no additional radiating element is necessary. This makes it possible to utilize effectively the antenna volume.

Additionally, the resonant frequency can be changed by using the first switch and the at least one impedance element. Therefore, the antenna according to the first aspect covers separate frequency bands or a wide frequency band formed by overlapping separate frequency bands.

In a preferred embodiment of the antenna according to the first aspect, a second grounding terminal electrically connected to the radiating element is further provided. In this embodiment, there is an additional advantage that the resonant frequency of the antenna can be readily increased.

In another preferred embodiment of the antenna according to the first aspect, a second grounding terminal electrically connected to the radiating element through a second switch is further provided. In this embodiment, there arises an additional advantage that the resonant frequency of the antenna can be changed by operating not only the first switch but also the second switch.

In still another preferred embodiment of the antenna according to the first aspect, at least one of an inductance element and a capacitance element is provided as the at least one impedance element. The first switch has a function of electrically connecting the first grounding terminal to the ground conductor through the at least one of the inductance element and the capacitance element and of electrically connecting the first grounding terminal to the ground conductor without the inductance element and the capacitance element.

In a further preferred embodiment of the antenna according to the first aspect, the first switch is a diode switch driven by a first driver circuit. In this embodiment, there is an additional advantage that the structure of the first switch is simplified.

The second switch may be a diode switch driven by a second driver circuit. In this embodiment, there is an additional advantage that the structure of both the first and second switches are simplified.

The radiating element may have a slit to increase the length of a current path. In this case, there is an additional advantage that the resonant frequency can be lowered without enlarging the volume of the antenna.

The radiating element may have folded parts for forming an additional capacitance element between the radiating element and the ground conductor. The additional capacitance element is electrically connected to link the radiating element with the ground conductor. In this case, there is an additional advantage that the resonant frequency can be lowered without enlarging the volume of the antenna.

According to a second aspect of the present invention, a radio communication system is provided, which is comprised of the inverted-F antenna according to the first aspect of the present invention, a receiver circuit for receiving a RF signal received by the antenna and outputting a selection signal for selecting one of available frequency bands, and a controller circuit for controlling an operation of the first switch by the selection signal.

With the radio communication system according to the second aspect of the present invention, the antenna according to the first aspect of the present invention is equipped. Therefore, there are the same advantages as shown in the antenna according to the first aspect of the present invention.

In a preferred embodiment of the system according to the second aspect, the resonant frequency of the antenna is selected so that power consumption of the system is minimized in a stand-by mode. In this embodiment, there is an additional advantage that total power consumption of the system is minimized.

In another preferred embodiment of the system according to the second aspect, a first driver circuit for driving the first switch is further provided. The first driver circuit supplies no driving current to the first switch in a stand-by mode. In this embodiment, there is an additional advantage that total power consumption of the system is minimized with a simplified configuration.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
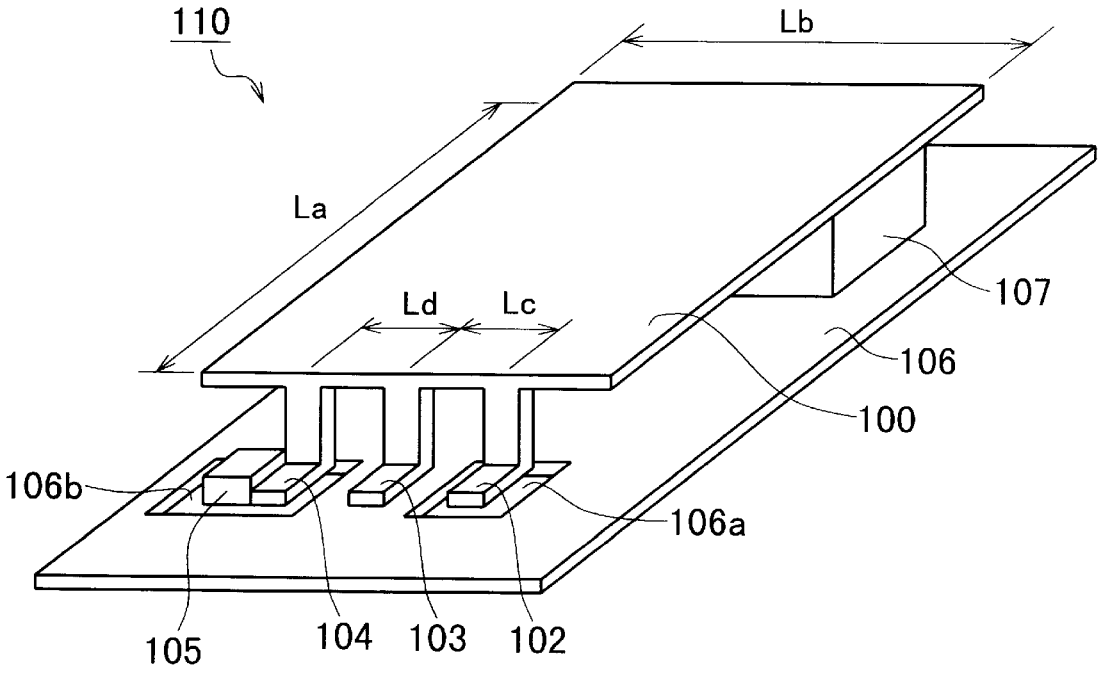
FIG. 1 PRIOR ART
FIG. 1 is a schematic perspective view showing a prior-art inverted-F antenna.
Figure 2:
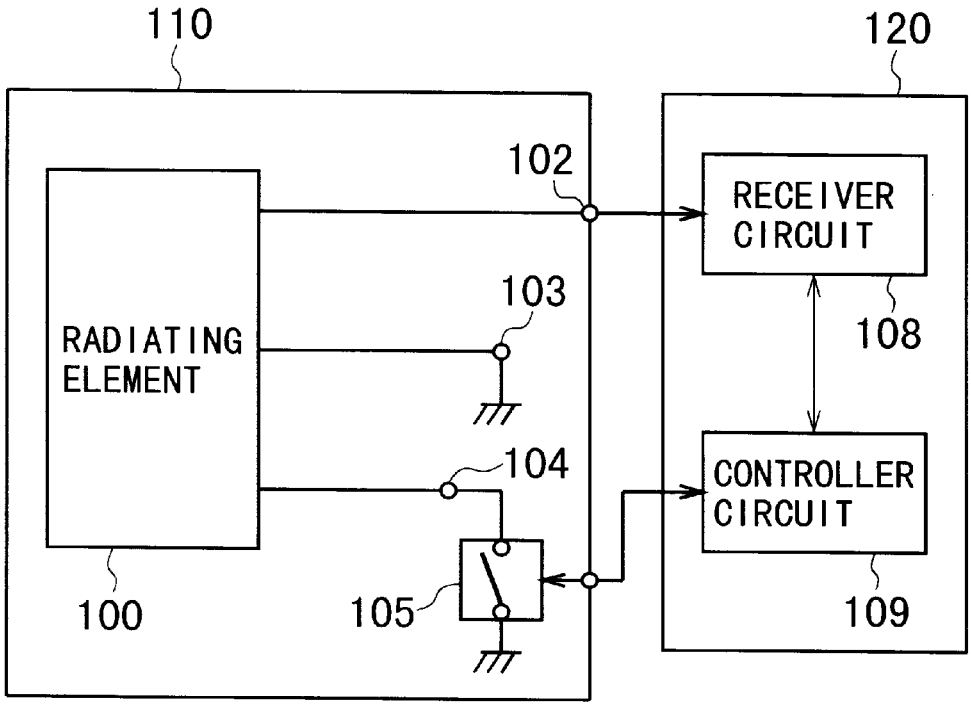
FIG. 2 PRIOR ART
FIG. 2 is a schematic, functional block diagram showing the configuration of the prior-art inverted-F antenna shown in FIG. 1.
Figure 3:
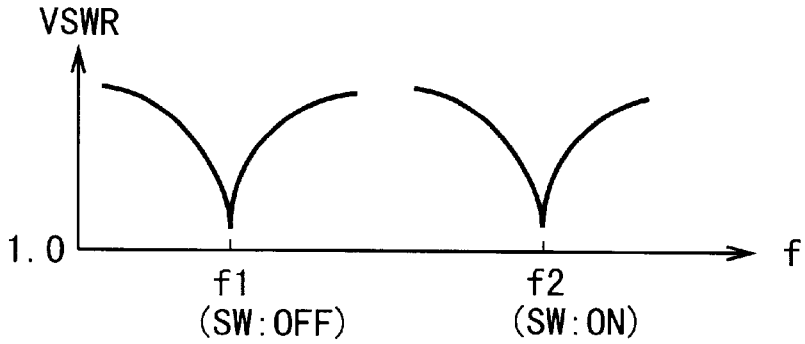
FIG. 3 PRIOR ART
FIG. 3 is a graph showing the frequency dependence of the VSWR of the prior-art inverted-F antenna shown in FIG. 1.

Preferred embodiments of the present invention will be described in detail below while referring to the drawings attached.

First Embodiment

Figure 4:
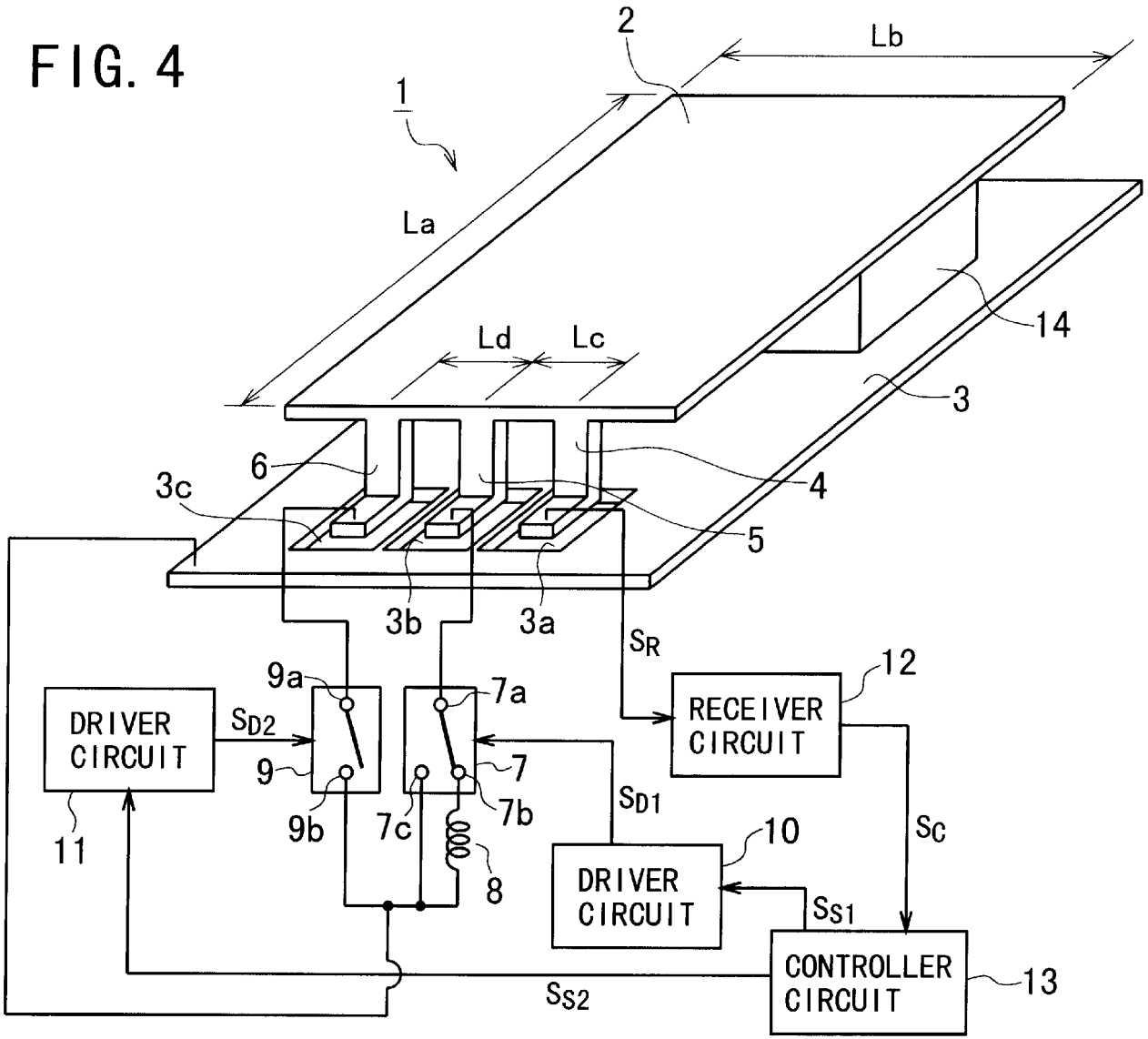
FIG. 4 is a schematic perspective view showing the configuration of an inverted-F antenna according to a first embodiment of the present invention, which is incorporated into a digital cellular phone.

An inverted-F antenna according to a first embodiment of the present invention is shown in FIG. 4, which is incorporated into a digital cellular phone. This antenna is used as a receiving antenna and therefore, the transmitter circuit of the phone is omitted in FIG. 4 for simplification of description.

(Configuration)

As shown in FIG. 4, the inverted-F antenna 1 according to the first embodiment is comprised of a rectangular conductor plate 2 serving as a radiating element, a rectangular ground plate 3 serving as a ground conductor, and a dielectric spacer 14 placed between the radiating element 2 and the ground conductor 3. The conductor plate 2 is opposite to the ground plate 3 and approximately in parallel thereto. The spacer 14 serves to fix the distance between the plate-shaped radiating element 2 and the plate-shaped ground conductor 3 at a specific value, thereby stabilizing the radiating characteristics of the antenna 1. The long-side length of the element 2 is La and the short-side length thereof is Lb.

The conductor plate or radiating element 2 has a feeding terminal 4 for feeding a RF electric signal to the element 2 or receiving a RF electric signal therefrom, and first and second grounding terminals 5 and 6 for grounding the element 2 to the ground conductor 3. These terminals 4, 5, and 6 are L-shaped and connected to one of the short-sides of the rectangular element 2. The pitch between the feeding terminal 4 and the first grounding terminal 5 is Lc. The pitch between the first and second grounding terminals 5 and 6 is Ld.

The first grounding terminal 5 is always used while changing the impedance value between the radiating element 2 and the ground conductor 3, i.e., changing the resonant frequency of the antenna 1. The second grounding terminal 6 is used for changing the resonant frequency of the antenna 1 as necessary.

The lower end of the feeding terminal 4, which is bent to be parallel to the ground conductor 3, is separated from the conductor 3 by a rectangular hole 3*a* penetrating the conductor 3. Therefore, the terminal 4 is not electrically connected to the conductor 3. The lower end of the terminal 4 is electrically connected to a receiver circuit 12 in the radio section of the digital cellular phone.

The lower end of the first grounding terminal 5, which is similarly bent to be parallel to the ground conductor 3, is separated from the conductor 3 by a rectangular hole 3*b* penetrating the conductor 3. Therefore, the terminal 5 is not electrically connected to the conductor 3 at this location. The lower end of the terminal 5 is electrically connected to one terminal 7*a* of a first switch 7 provided outside the conductor 3 in the digital cellular phone. Another two terminals 7*b* and 7*c* of the first switch 7 are electrically connected to the conductor 3. This means that the first grounding terminal 5 is electrically connected through the first switch 7 to the ground conductor 3.

As seen from FIG. 4, an inductor element or coil 8 is connected to the terminal 7*b* while no impedance element is connected to the terminal 7*c*. Thus, the inductor 8 can be inserted into the line connecting the first grounding terminal 5 and the ground conductor 3 or disconnected from the line by operating the first switch 7.

The lower end of the second grounding terminal 6, which is similarly bent to be parallel to the ground conductor 3, is separated from the conductor 3 by a rectangular hole 3*c* penetrating the conductor 3. Therefore, the terminal 6 also is not electrically connected to the conductor 3 at this location. The lower end of the terminal 6 is electrically connected to one terminal 9*a* of a second switch 9 provided outside the conductor 3 in the digital cellular phone. The other terminal 9*b* of the second switch 9 is electrically connected to the conductor 3. This means that the second grounding terminal 6 is electrically connected through the second switch 9 to the ground conductor 3.

As seen from FIG. 4, unlike the first switch 7, no impedance element is connected to the terminal 9*b* of the second switch 9. This means that the switch 9 performs a simple ON-OFF operation and as a result, the second grounding terminal 6 can be selectively activated or used as necessary by operating the second switch 9.

The first and second switches 7 and 9 are driven by first and second driver circuits 10 and 11 provided outside the conductor 3 in the digital cellular phone, respectively. The first and second driver circuits 10 and 11 are controlled by a controller circuit 13 of the cellular phone.

If the first switch 7 is operated to connect the terminal 7*a* to the terminal 7*b*, the first grounding terminal 5 is electrically connected to the ground conductor 3 through the inductor 8. If the first switch 7 is operated to connect the terminal 7*a* to the terminal 7*c*, the first grounding terminal 5 is electrically connected to the ground conductor 3 directly (i.e., without the inductor 8).

If the second switch 9 is turned off, the second grounding terminal 6 is not electrically connected to the ground conductor 3, in which only the first grounding terminal 4 is used. If the second switch 9 is turned on, the second grounding terminal 6 is electrically connected to the conductor 3, in which not only the first grounding terminal 5 but also the second grounding terminal 6 are used.

The conductor plate or radiating element 2 is typically formed by a rectangular metal plate. However, any other conductive material may be used for forming the element 2. The three terminals 4, 5, and 6 may be simply formed by bending three protrusions of a rectangular metal plate for the element 2. The ground plate or ground conductor 3 is formed by a rectangular metal plate or a conductor layer (e.g., a copper foil) of a printed circuit board.

In the first embodiment, the radiating element 2 is formed by a rectangular metal plate, the terminals 4, 5, and 6 are formed by bending three protrusions of the rectangular metal plate for the element 2. The ground conductor 3 is formed by a rectangular metal plate. The ground conductor 3 is supported by a printed circuit board (not shown) on which the first and second switches 7 and 9, the inductor 8, the first and second driver circuits 10 and 11, the receiver circuit 12, and the control circuit 13 are formed.

The receiver circuit 12 reproduces the transmitted information or message from a communicating, distant cellular phone. The circuit 12 has a popular configuration including a RF amplifier, frequency converters, a demodulator, and so on. (Operation)

Next, the operation of the cellular phone shown in FIG. 4 is explained below with reference to FIGS. 5, 6, 14, 15, and 16.

Figure 5:
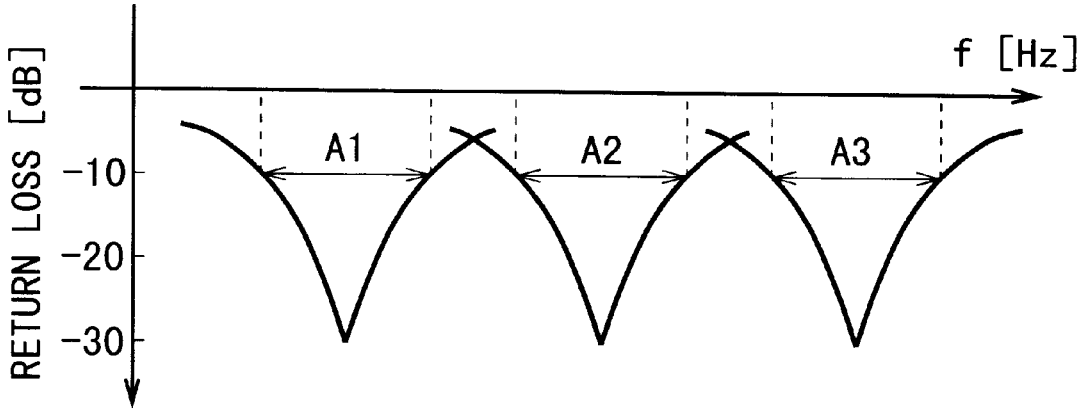
FIG. 5 is a graph showing the frequency dependence of the return loss of the inverted-F antenna according to the first embodiment of FIG. 4, in which three separate frequency bands are covered.

When the RF signal $S_R$ detected by the inverted-F antenna 1 is within a middle frequency band A2 as shown in FIG. 5, the receiver circuit 12 sends a channel signal $S_C$ corresponding to the band A2 to the controller circuit 13. Then, in response to the channel signal $S_C$, the controller circuit 13 sends a first switching signal $S_{S1}$ (e.g., a high-level signal) to the first driver circuit 10 and at the same time, the controller circuit 13 sends a second switching signal $S_{S2}$ (e.g., a low-level signal) to the second driver circuit 11.

In response to the first switching signal $S_{S1}$, the first driver circuit 10 sends a first driving signal $S_{D1}$ to the first switch 7, thereby connecting the terminal 7*a* to the terminal 7*c*. Thus, the first grounding terminal 5 is electrically connected to the ground conductor 3 directly (i.e., without the inductor 8). Similarly, in response to the second switching signal $S_{S2}$, the second driver circuit 11 sends a second driving signal $S_{D2}$ to the second switch 9, thereby disconnecting the terminal 9*a* from the terminal 9*b*. Thus, the second grounding terminal 6 is not electrically connected to the ground conductor 3.

Figure 14:
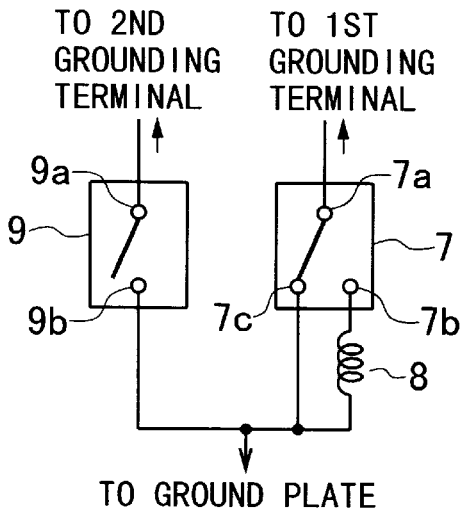
FIG. 14 is a schematic view showing the state of the first and second switches, in which the first switch connects directly the first grounding terminal to the ground plate while the second switch disconnects the second grounding terminal from the ground plate.

The state of the first and second switches 7 and 9 at this stage is shown in FIG. 14.

Accordingly, when the RF signal $S_R$ is within the frequency band A2, the inverted-F antenna 1 has the feeding terminal 4 and the first grounding terminal 5 without the inductor 8, which is a very popular configuration. After the first and second switches 7 and 9 are driven to have the state shown in FIG. 14, the antenna 1 receives the RF signal $S_R$ in the band A2 and the receiver circuit 12 performs its predetermined demodulation operation for the signal $S_R$ thus received.

Next, when the RF signal $S_R$ detected by the inverted-F antenna 1 is within a lower frequency band A1 than the band A2, the receiver circuit 12 sends a channel signal $S_C$ corresponding to the band A1 to the controller circuit 13. Then, in response to the channel signal $S_C$, the controller circuit 13 sends a first switching signal $S_{S1}$ (e.g., a low-level signal) to the first driver circuit 10 and at the same time, the controller circuit 13 sends a second switching signal $S_{S2}$ (e.g., a low-level signal) to the second driver circuit 11.

The first switching signal $S_{S1}$ for the band A1 has an opposite level to that for the band A2. The second switching signal $S_{S1}$ for the band A1 has the same level as that for the band A2.

In response to the first switching signal $S_{S1}$, the first driver circuit 10 sends a first driving signal $S_{D1}$ to the first switch 7, thereby connecting the terminal 7*a* to the terminal 7*b* instead of the terminal 7*c*. Thus, the first grounding terminal 5 is electrically connected to the ground conductor 3 through the inductor 8. Similarly, in response to the second switching signal $S_{S2}$, the second driver circuit 11 sends a second driving signal $S_{D2}$ to the second switch 9, thereby disconnecting the terminal 9*a* from the terminal 9*b*. Thus, the second grounding terminal 6 is not electrically connected to the ground conductor 3.

Figure 15:
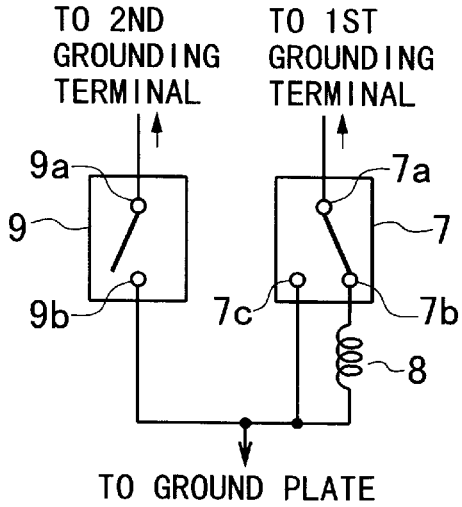
FIG. 15 is a schematic view showing the state of the first and second switches, in which the first switch connects the first grounding terminal to the ground plate through the inductor while the second switch disconnects the second grounding terminal from the ground plate.

The state of the first and second switches 7 and 9 at this stage is shown in FIG. 15.

As explained above, when the RF signal $S_R$ is within the lower frequency band A1, the inverted-F antenna 1 has the feeding terminal 4 and the first grounding terminal 5 with the inductor 8. After the first and second switches 7 and 9 are driven to have the state shown in FIG. 15, the antenna 1 receives the RF signal $S_R$ in the band A1 and the receiver circuit 12 performs its predetermined demodulation operation for the signal $S_R$ thus received.

As seen from the above, when the RF signal $S_R$ is within the lower frequency band A1, the inductor 8 is inserted into the line connecting the first grounding terminal 5 and the ground conductor 3. The inserted inductor 8 has a function of lowering the resonant frequency of the antenna 1. As a result, the antenna 1 is capable of receiving the signal $S_R$ within the band A1 lower than the band A2.

Figure 8:
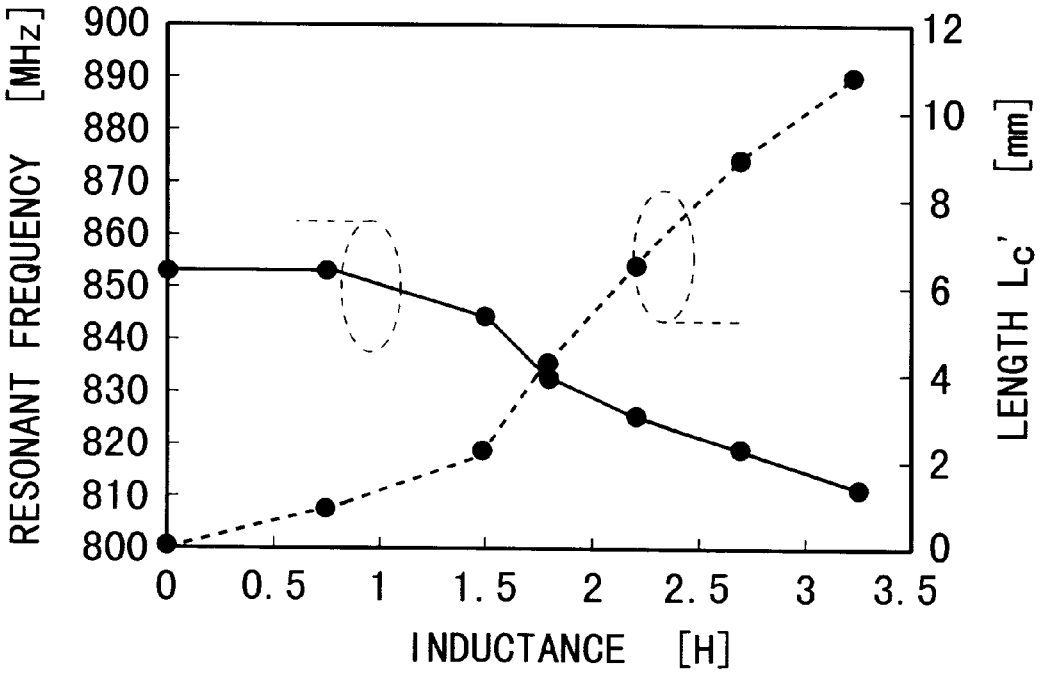
FIG. 8 is a graph showing the relationship between the resonant frequency and the inductance value of an inductor and that between the length Lc' of the linking plate and the inductance value in the inverted-F antenna according to the first embodiment of FIG. 4.

FIG. 8 shows the relationship between the resonant frequency of the antenna 1 and the inductance value of the inductor 8. It is seen from FIG. 8 that the resonant frequency lowers gradually as the inductance value increases.

On the other hand, as the inductance value of the inductor 8 increases, the input impedance of the antenna 1 changes. Therefore, there may arise a disadvantage that the input impedance has a value greater than a desired value of the characteristic impedance (e.g., 50 Ω), in other words, the impedance matching between the antenna 1 and the receiver circuit 12 is failed. This disadvantage can be canceled in the following way.

Figure 9:
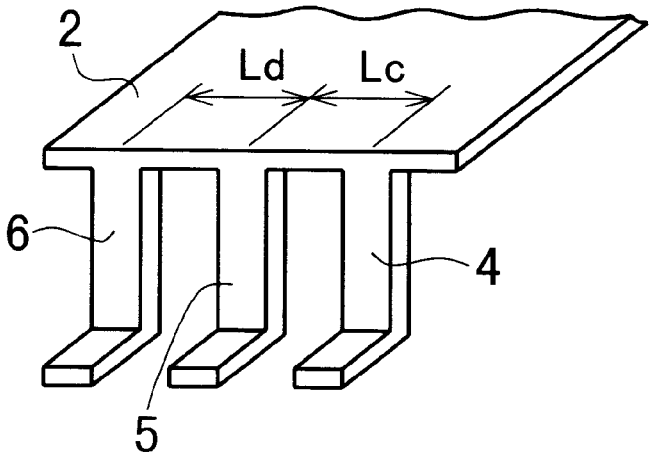
FIG. 9 is a schematic, partial perspective view of the radiating element with the feeding terminal and the first and second grounding terminals of the inverted-F antenna according to the first embodiment of FIG. 4.
Figure 10:
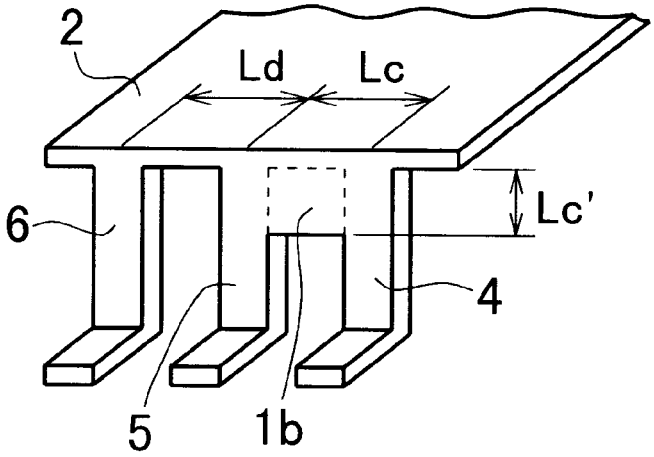
FIG. 10 is a schematic, partial perspective view of the radiating element with the feeding terminal and the first and second grounding terminals of the inverted-F antenna according to the first embodiment of FIG. 4, in which the linking plate is provided between the feeding terminal and the first grounding terminal.

As known well, as shown in FIG. 9, the input impedance of the inverted-F antenna 1 can be varied by changing the pitch Lc between the feeding terminal 4 and the first grounding terminal 5. Also, as shown in FIG. 10, if a rectangular, conductive linking plate 16 is formed or added to link the adjoining terminals 4 and together and to contact with the radiating element 2, the input impedance of the antenna 1 can be varied by changing the length Lc' of the linking plate 16. Therefore, even if the input impedance value of the antenna 1 becomes unequal to the characteristic impedance value due to the increase of the inductance value, the impedance matching between the antenna 1 and the receiver circuit 12 can be restored by changing suitably the length Lc' of the linking plate 16.

It is needless to say that the inductor 8 may be replaced with a capacitor. In this case, the resonant frequency of the antenna 1 rises with the increasing the capacitance value, which is opposite to the case of the inductor 8.

Moreover, when the RF signal $S_R$ detected by the inverted-F antenna 1 is within a frequency band A3 higher than the band A2, the receiver circuit 12 sends a channel signal $S_C$ corresponding to the band A3 to the controller circuit 13. Then, in response to the channel signal $S_C$, the controller circuit 13 sends a first switching signal $S_{S1}$ (e.g., a low-level signal) to the first driver circuit 10 and at the same time, the controller circuit 13 sends a second switching signal $S_{S2}$ (e.g., a high-level signal) to the second driver circuit 11.

The first switching signal $S_{S1}$ for the band A3 has the same level as that for the band A1. The second switching signal $S_{S2}$ for the band A3 has an opposite level to that for the band A1.

In response to the first switching signal $S_{S1}$, the first driver circuit 10 sends a first driving signal $S_{D1}$ to the first switch 7, thereby connecting the terminal 7*a* to the terminal 7*b*. Thus, the first grounding terminal 5 is electrically connected to the ground conductor 3 through the inductor 8. Similarly, in response to the second switching signal $S_{S2}$, the second driver circuit 11 sends a second driving signal $S_{D2}$ to the second switch 9, thereby connecting the terminal 9*a* to the terminal 9*b*. Thus, the second grounding terminal 6 is electrically connected to the ground conductor 3 (i.e., the terminal 6 is activated).

Figure 16:
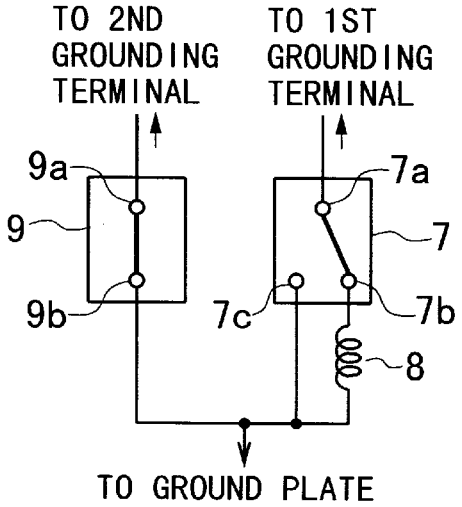
FIG. 16 is a schematic view showing the state of the first and second switches, in which the first switch connects the first grounding terminal to the ground plate through the inductor while the second switch connects the second grounding terminal to the ground plate.

The state of the first and second switches 7 and 9 at this stage is shown in FIG. 16.

As explained above, when the RF signal $S_R$ is within the higher frequency band A3, the inverted-F antenna 1 has the feeding terminal 4, the first grounding terminal 5 with the inductor 8, and the second grounding terminal 6. After the first and second switches 7 and 9 are driven to have the state shown in FIG. 16, the antenna 1 receives the RF signal $S_R$ in the band A3 and the receiver circuit 12 performs its predetermined demodulation operation for the signal $S_R$ thus received.

Thus, when the RF signal $S_R$ is within the higher frequency band A3, both the first and second grounding terminals 5 and 6 are used, which is equivalent to the fact that the width of the first grounding terminal 5 is enlarged. It is known that the resonant frequency of the antenna 1 rises with the increasing width of the first grounding terminal 5. As a result, the antenna 1 operates to receive the signal $S_R$ in the higher frequency band A3 than the band A2.

FIG. 5 shows the frequency dependence of the return loss of the antenna 1 from the feeding terminal 4. As seen from FIG. 5, the inverted-F antenna 1 is capable of receiving the RF signal $S_R$ in any one of the three frequency bands A1, A2, and A3, in other words, the antenna 1 covers the three separate frequency bands A1, A2, and A3.

Figure 6:
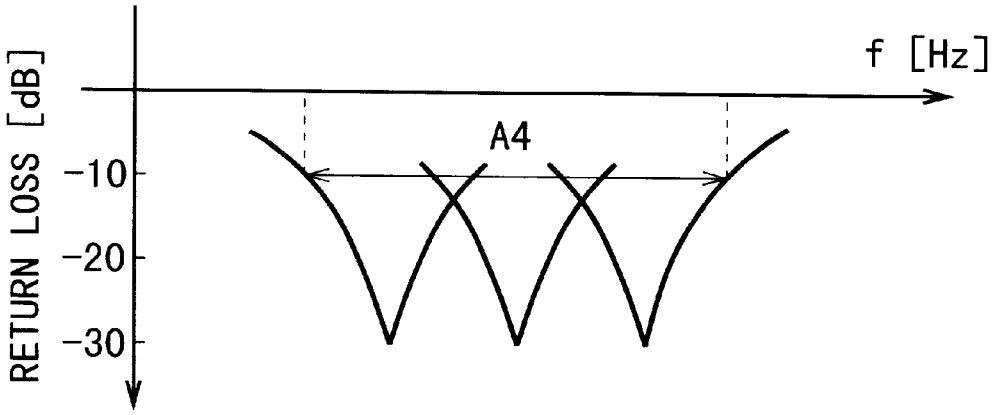
FIG. 6 is a graph showing the frequency dependence of the return loss of the inverted-F antenna according to the first embodiment of FIG. 4, in which a wide frequency band formed by overlapping three separate frequency bands are covered.

If the three frequency bands A1, A2, and A3 are adjusted to overlap with one another, the antenna 1 covers a single wide frequency band A4 wider than any of the bands A1, A2, and A3, as shown in FIG. 6.

With the inverted-F antenna 1 according to the first embodiment of the present invention, the inductor 8 is provided in the line connecting the first grounding terminal 5 to the ground conductor 3 and at the same time, it is selectively inserted into the line by operating the first switch 7. The second grounding conductor 6 is electrically connected to the ground conductor 3 through the second switch 9. Thus, the resonant frequency of the antenna 1 can be changed by operating at least one of the first and second switches 7 and 9.

On the other hand, since the resonant frequency of the antenna 1 is changed by using the inductor 8 and the first and second switches 7 and 9, another grounding terminal for electrically connecting the radiating element 2 to the ground conductor 3 is unnecessary in order o cope with the change or addition of available frequency bands. This means that the change or addition of available frequency bands can be realized without increasing the size of the antenna 1.

As a result, the antenna 1 according to the first embodiment is capable of coping with the change or addition of available frequency bands while keeping its compactness.

Also, the resonant frequency can be adjusted easily within a narrow range by adjusting the inductance value of the inductor 8. Thus, the operating frequency band of the antenna the antenna 1 can be optionally switched at a narrow interval or intervals.

Moreover, because the resonant frequency is changed by operating at least one of the first and second switches 7 and 9, no additional radiating element is necessary. This makes it possible to utilize effectively the antenna volume.

Additionally, the resonant frequency can be changed by using at least one of the first and second switches 7 and 9 and the inductor. Therefore, the antenna 1 covers separate frequency bands or a wide frequency band formed by overlapping separate frequency bands.

(Adjustment Method)

The dimension of the antenna 1 may be adjusted in the following way.

First, the perimeter L of the radiating element 2 is determined so as to satisfy the following equation $$L = (2La + 2Lb) \approx \frac{\lambda}{2}$$

where λ is the free-space propagation wavelength of the RF signal $S_R$ in the middle frequency band A2.

Second, to adjust the resonant frequency of the antenna 1 to meet the lower frequency band A1., the necessary increment or decrement of the inductance value of the inductor 8 for realizing the required resonant frequency for the band A1 is read out from the graph in FIG. 8. The inductance value of the inductor 8 is determined to equal the necessary inductance change thus read out.

Finally, to adjust the resonant frequency of the antenna 1 to meet the higher frequency band A3, the pitch Ld between the first and second grounding terminals 5 and 6 is suitably adjusted to realize the required resonant frequency for the band A3 by any known way.

(Detailed Configuration)

Figure 7:
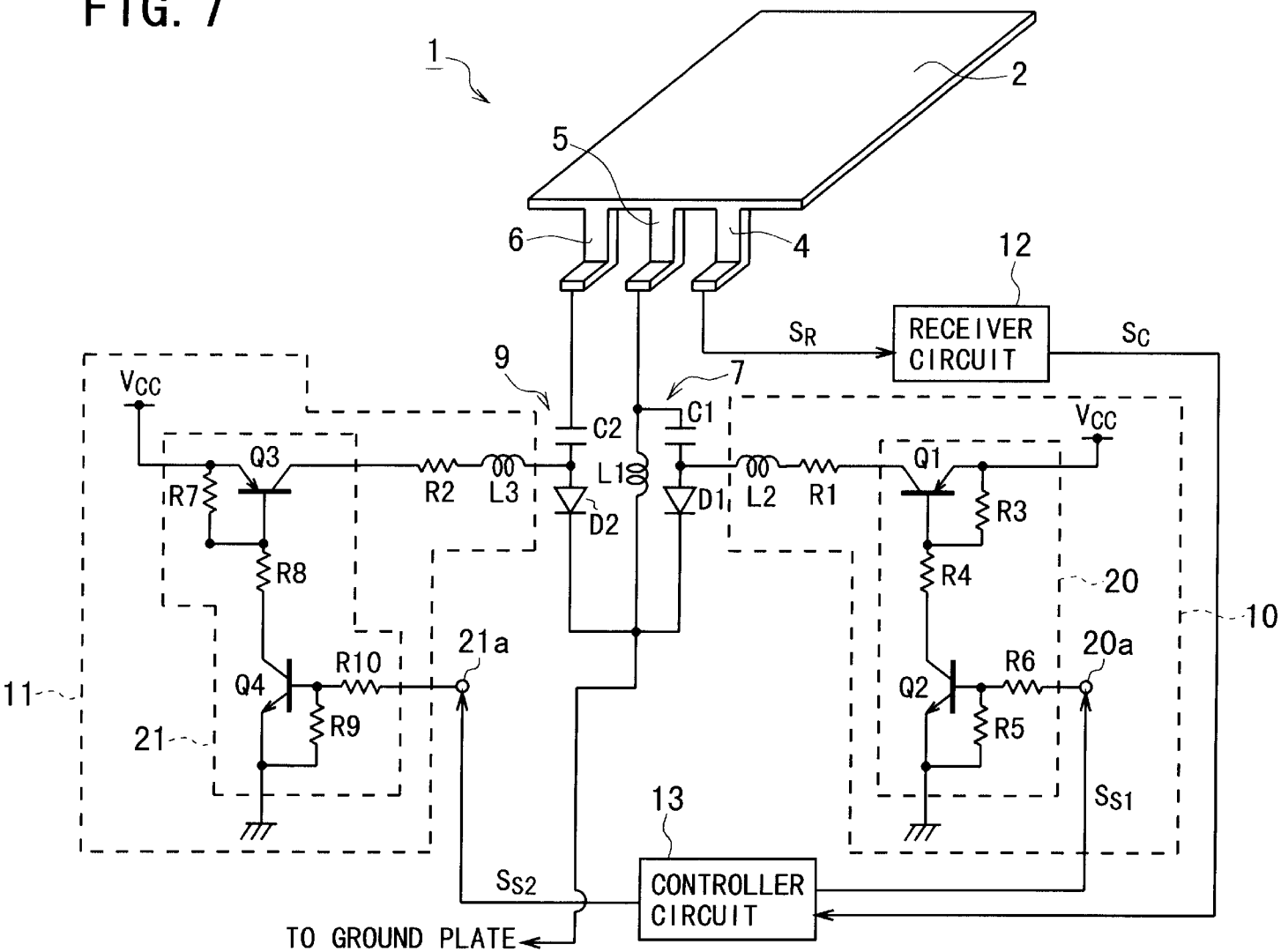
FIG. 7 is a schematic view showing the circuit configuration of the digital cellular phone including the inverted-F antenna according to the first embodiment of FIG. 4.

FIG. 7 shows the circuit configuration of the digital cellular phone including the inverted-F antenna 1 according to the first embodiment of FIG. 4.

As seen from FIG. 7, diodes D1 and D2 are respectively used as the first and second switches 7 and 9, and a coil L1 is used as the inductor 8. Coupling capacitors C1 and C2 are connected in series to the diodes D1 and D2, respectively. To minimize the effect of the inserted capacitors C1 and C2, the capacitance values of the capacitors C1 and C2 are so determined that their impedance values in the frequency bands A1, A2, and A3 (or in the frequency band A4) are sufficiently low.

The first grounding terminal 5 is electrically connected to the ground plate 3 through the combination of the serially-connected capacitor C1 and the diode D1 or through the coil L1. The second grounding terminal 6 is electrically connected to the ground plate 3 through the combination of the serially-connected capacitor C2 and the diode D2.

The first driver circuit 10 has a first switching circuit 20, and a resistor R1 and a choke coil L2 serially-connected to each other. The first switching circuit 20 is electrically connected to the first switch 7 at the connection point between the diode D1 and the capacitor C1 through the resistor R1 and the choke coil L2.

The first switching circuit 20 comprises a pnp-type bipolar transistor Q1, an npn-type bipolar transistor Q2, and resistors, R3, R4, R5, and R6. The emitter of the transistor Q1 is connected to a power supply (not shown) and applied with a supply voltage $V_{CC}$. The collector of the transistor Q1 is connected to the first switch 7 through the resistor R1 and the choke coil L2. The resistor R3 is connected to link the emitter and the base of the transistor Q1. The resistor R4 is connected to link the base of the transistor Q1 to the collector of the transistor Q2. The resistor R5 is connected to link the emitter and the base of the transistor Q2. The resistor R6 is connected to link the base of the transistor Q2 and an input terminal 20*a* of the first switching circuit 20. The emitter of the transistor Q2 is connected to the ground.

Similarly, the second driver circuit 11 has a second switching circuit 21, and a resistor R2 and a choke coil L3 serially-connected to each other. The second switching circuit 21 is electrically connected to the second switch 9 at the connection point between the diode D2 and the capacitor C2 through the resistor R2 and the choke coil L3.

The second switching circuit 21 comprises a pnp-type bipolar transistor Q3, an npn-type bipolar transistor Q4, and resistors, R7, R8, R9, and R10. The emitter of the transistor Q3 is connected to the power supply and applied with the supply voltage $V_{CC}$. The collector of the transistor Q2 is connected to the second switch 9 through the resistor R2 and the choke coil L3. The resistor R7 is connected to link the emitter and the base of the transistor Q3. The resistor R8 is connected to link the base of the transistor Q3 to the collector of the transistor Q4. The resistor R9 is connected to link the emitter and the base of the transistor Q4. The resistor R10 is connected to link the base of the transistor Q4 and an input terminal 21*a* of the second switching circuit 21. The emitter of the transistor Q4 is connected to the ground.

To minimize the effect of the first and second driver circuits 11 and 12 to the antenna performance, the inductance values of the choke coils L2 and L3 are so determined that their impedance values in the frequency bands A1, A2, and A3 (or in the frequency band A4) are sufficiently high.

Next, the operation of the first and second driver circuits 11 and 12 and the first and second switches 7 and 9 in FIG. 7 is explained below.

When the middle frequency band A2 is selected, the first switching signal $S_{S1}$ outputted from controller circuit 13 is of the high-level and the second switching signals $S_{S2}$ outputted from controller circuit 13 is of the low-level. Then, in the first switching circuit 20, since the first switching signal $S_{S1}$ 13 is of the high-level, the transistors Q2 and Q1 are turned on, thereby producing an output current of the first switching circuit 20. The output current thus produced flows through the diode D1, turning the diode D1 on. At this time, since the impedance of the capacitor C1 is set to be sufficiently low in the required frequency band or bands, the first grounding terminal 5 is directly connected to the ground plate 3 with respect to the RF signal $S_R$. The first grounding terminal 5 is not connected to the ground plate 3 through the coil or inductor L1, because the coil L1 has an impedance sufficiently higher than that of the capacitor C1 in the required frequency band or bands.

In the second switching circuit 20, since the second switching signals $S_{S2}$ is of the low-level, the transistors Q4 and Q3 are remained off, i.e., the second switching circuit 20 outputs no output current. Thus, the diode D2 exhibits a high impedance, which means that the second switch 9 is, turned off. As a result, the second grounding terminal 6 is disconnected from the ground plate 3 with respect to the RF signal $S_R$.

Accordingly, when the middle frequency band A2 is selected, only the first grounding terminal 5 is activated or used without using the coil L1 as the inductor 8. Because the impedance values of the choke coils L2 and L3 are set sufficiently high in the frequency bands A1, A2, and A3 (or in the frequency band A4), the effect of the first and second driver circuits 11 and 12 to the antenna performance can be ignored.

When the lower frequency band A1 is selected, both the first and second switching signals $S_{S1}$ and $S_{S2}$ are of the low-level. In the first switching circuit. 20, the transistors Q2 and Q1 are turned off and no output current is outputted. Thus, the diode D1 is turned off, connecting the first grounding terminal 5 to the ground plate 3 through the coil L1 with respect to the RF signal $S_R$.

The second switching circuit 21 outputs no output current and the diode D2 exhibits a high impedance, i.e., the second switch 9 is off. As a result, the second grounding terminal 6 is disconnected from the ground plate 3 with respect to the RF signal $S_R$.

Accordingly, when the lower frequency band A2 is selected, only the first grounding terminal 5 is activated or used while using the coil L1 as the inductor 8, thereby lowering the resonant frequency of the antenna 1 with respect to that in the middle frequency band A1.

When the higher frequency band A3 is selected, the first switching signal $S_{S1}$ is of the low-level. The first switching circuit 20 outputs no output current and the diode D1 is turned off, connecting the first grounding terminal 5 to the ground plate 3 through the coil L1 with respect to the RF signal $S_R$.

In the second switching circuit 21, since the second switching signals $S_{S2}$ is of the high-level, the transistors Q4 and Q3 are turned on, thereby producing an output current of the second switching circuit 21. The output current thus produced flows through the diode D2, turning the diode D2 on. At this time, since the impedance of the capacitor C2 is set to be sufficiently low in the required frequency band A3, the second grounding terminal 6 is connected to the ground plate 3 with respect to the RF signal $S_R$.

Accordingly, when the higher frequency band A3 is selected, both the first and second grounding terminals 5 and 6 are activated while using the coil L1 as the inductor 8. The addition of the second ground terminal 6 corresponds or equivalent to the widening of the first grounding terminal 5 and therefore, the resonant frequency of the antenna 1 in the band A3 becomes higher than that in the middle frequency band A1.

As known well, the diodes D1 and D2 have a characteristic that the on-impedance becomes lower as the current flowing through the diodes D1 and D2 increases. Therefore, the resistance values of the resistors R1 and R2 are determined so that the on-impedance values of the diodes D1 and D2 are equal to desired values.

The capacitance values of the capacitors C1 and C2 and the inductance values of the choke coils L2 and L3 are suitably determined according to the operating frequency band or bands (e.g., A1, A2, and A3, or A4). For example, if the operating frequency band is approximately 800 MHz, it is preferred that the capacitance values of the capacitors C1 and C2 are approximately 100 pF and the inductance values of the choke coils L2 and L3 are approximately 100 nH.

In the circuit configuration shown in FIG. 7, the first and second driver circuits 10 and 11 are necessary, because the diodes D1 and D2 are used as the first and second switches 7 and 9. However, the first and second driver circuits 10 and 11 may be canceled if the first and second switches 7 and 9 are formed by elements or devices capable of direct control by the controller circuit 13, such as GaAs (Gallium Arsenide) FETs (Field-Effect Transistors) or a GaAs switching IC (Integrated Circuit).

In cellular phone having the antenna 1 according to the first embodiment of FIG. 4, it is preferred that the lower frequency band A1 is designed to be selected in the stand-by mode. This is due to the following reason.

In the lower frequency band A1, as explained above, both the first and second switching circuits 20 and 21 are turned off. Therefore, no driving current flows through the first and second driver circuits 10 and 11 in the stand-by mode. This means that there is an advantage that power consumption of the system is minimized.

Second Embodiment

Figure 11:
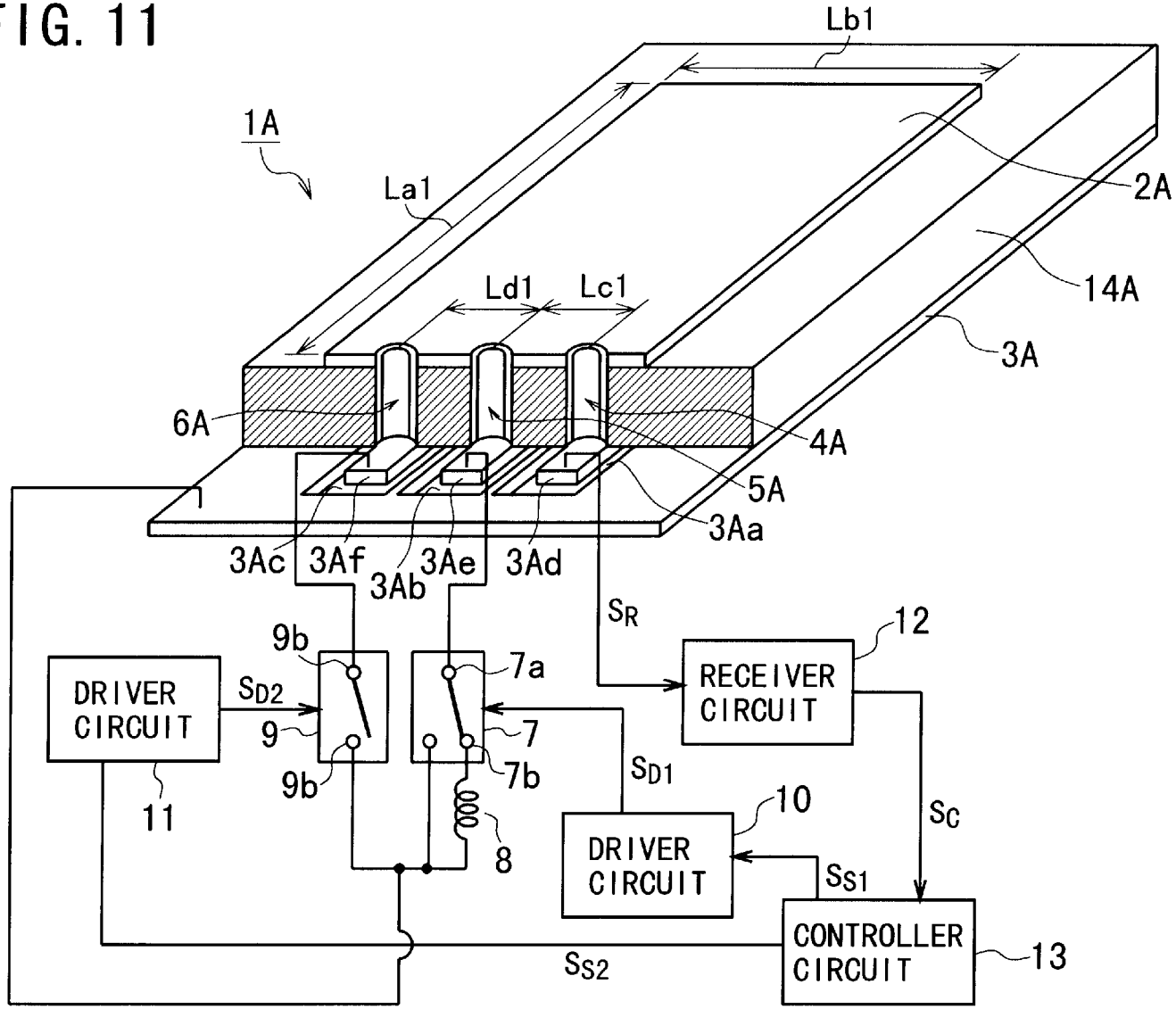
FIG. 11 is a schematic perspective view showing the configuration of an inverted-F antenna according to a second embodiment of the present invention, which is incorporated into a digital cellular phone.

FIG. 11 shows an inverted-F antenna 1A according to a second embodiment of the present invention. This antenna 1A is incorporated into a digital cellular phone having the same configuration as that explained in the first embodiment of FIG. 4. Therefore, the explanation about the first and second switches 7 and 9, the first and second driver circuits 10 and 11, the receiver circuit 12, and the controller circuit 13 are omitted here for simplification of description by attaching the same reference symbols as those in FIG. 4.

As described above, the inverted-F antenna 1 according to the first embodiment is formed by metal plates. Unlike this, the inverted-F antenna 1A according to the second embodiment is formed by using printed wiring boards.

Specifically, a printed wiring board, i.e., a copper-clad laminate comprises a rectangular base material 14A and two rectangular copper foils or layers formed on the two surfaces of the material 14A. The base material 14A is made of a dielectric such as Teflon or glass-epoxy and has a relative dielectric constant of $\epsilon_r$. The upper copper layer of the laminate is patterned by etching to thereby form a rectangular radiating element 2A having a length of La1 and a width of Lb1. The lower copper layer of the laminate is suitably patterned by etching as necessary.

A rectangular ground conductor 3A and three island conductors 3A*d*, 3A*e*, and 3A*f* are formed by patterning an upper copper layer of another printed wiring board for forming the circuitry of the cellular phone. A dielectric base material of this printed wiring board is not: shown in FIG. 11 for simplification. The upper copper layer has three rectangular penetrating holes 3A*a*, 3A*b*, and 3A*c* for separating respectively the island conductors 3A*d*, 3A*e*, and 3A*f* from the ground conductor 3A.

The base material 14A has three plated through holes located at one of the short-sides of the base material 14A.

The plated through holes are contacted with and electrically connected to the radiating element 2A. The plated through holes are further contacted with and electrically connected to the island conductors 3A*d*, 3A*e*, and 3A*f*, respectively, thereby forming a feeding terminal 4A, a first grounding terminal 5A, and a second grounding terminal 6A, respectively. The island conductors 3A*d*, 3A*e*, and 3A*f* are exposed from the base material 14A. The pitch of the feeding terminal 4A and the first grounding terminal 5A is Lc1. The pitch of the first and second grounding terminals 5A and 6A is Ld1.

The island conductor 3A*d* (i.e., the feeding terminal 5A) is electrically connected to the receiver circuit 12. The island conductor 3Ae (i.e., the first grounding terminal 5A) is electrically connected to the ground conductor 3A through the first switch 7. The island conductor 3A*f* (i.e., the second grounding terminal 6A) is electrically connected to the ground conductor 3A through the second switch 9.

With the inverted-F antenna 1A according to the second embodiment of FIG. 11, the dielectric base material 14A is located between the radiating element 2A and the ground conductor 3A. Therefore, in addition to the same advantages as those in the first embodiment of FIG. 4, there is an additional advantage that the size or dimension of the radiating element 2A can be reduced according to the relative dielectric constant $\epsilon_r$ of the base material 14A compared with the case where the dielectric base material 14A is not used. Moreover, there is another additional advantage that the radiation characteristics of the antenna 1A can be stabilized without using the spacer 14.

When the first grounding terminal 5A is electrically connected to the ground conductor 3A while the second grounding terminal 5A is electrically disconnected from the ground conductor 3A, the resonant frequency $f_y$ of the antenna 1A is given by the following equation.

$$L_y = (2La1 + 2Lb1) \approx \left(\frac{\lambda}{2}\right)\sqrt{\varepsilon_r}$$
$$= (2La1 + 2Lb1) \approx \left(\frac{f_y}{2c}\right)\sqrt{\varepsilon_r}$$

where $L_y$ is the perimeter of the radiating element 2A and c is the velocity of light.

Thus, the size of the radiating element 2A is reduced to $$\frac{1}{\sqrt{\varepsilon_r}}$$

of that of the case where the dielectric base material 14A is not used.

Third Embodiment

Figure 12:
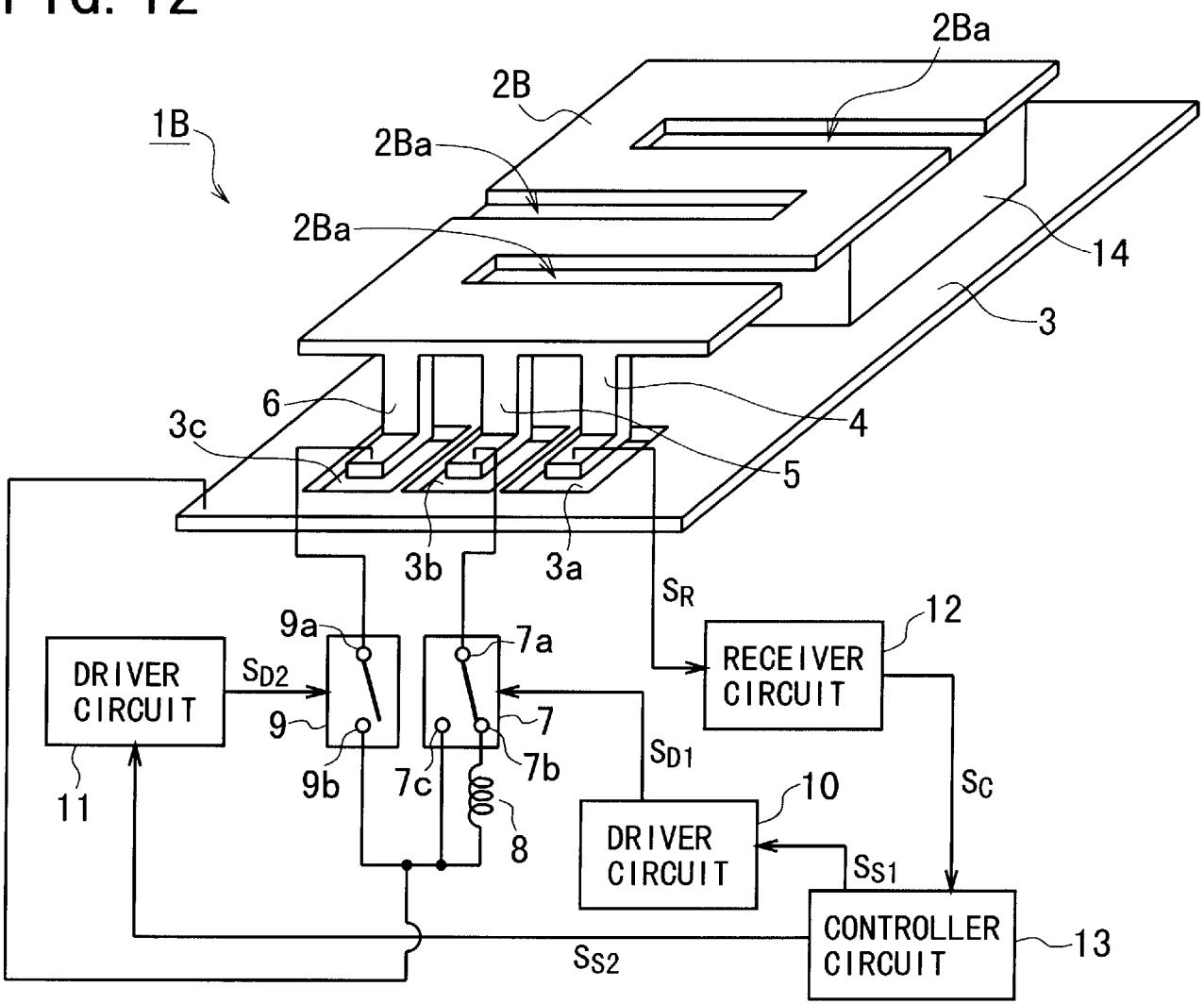
FIG. 12 is a schematic perspective view showing the configuration of an inverted-F antenna according to a third embodiment of the present invention, which is incorporated into a digital cellular phone.

FIG. 12 shows an inverted-F antenna 1B according to a third embodiment of the present invention, which is incorporated into a digital cellular phone having the same configuration as that explained in the first embodiment of FIG. 4.

The antenna 1B has the same configuration as that of the antenna 1 according to the first embodiment of FIG. 4 except that a rectangular plate-shaped radiating element 2B has three linear slits 2B*a* arranged at intervals in parallel to the short sides of the element 2B. Due to the slits 2B*a*, the current path length is increased without increasing the length of the element 2B, thereby lowering the resonant frequency of the antenna 1B without increasing the size of the antenna 1B. In other words, the size of not only the element 2B but also the antenna 1B itself can be decreased while keeping the resonant frequency unchanged.

Fourth Embodiment

Figure 13:
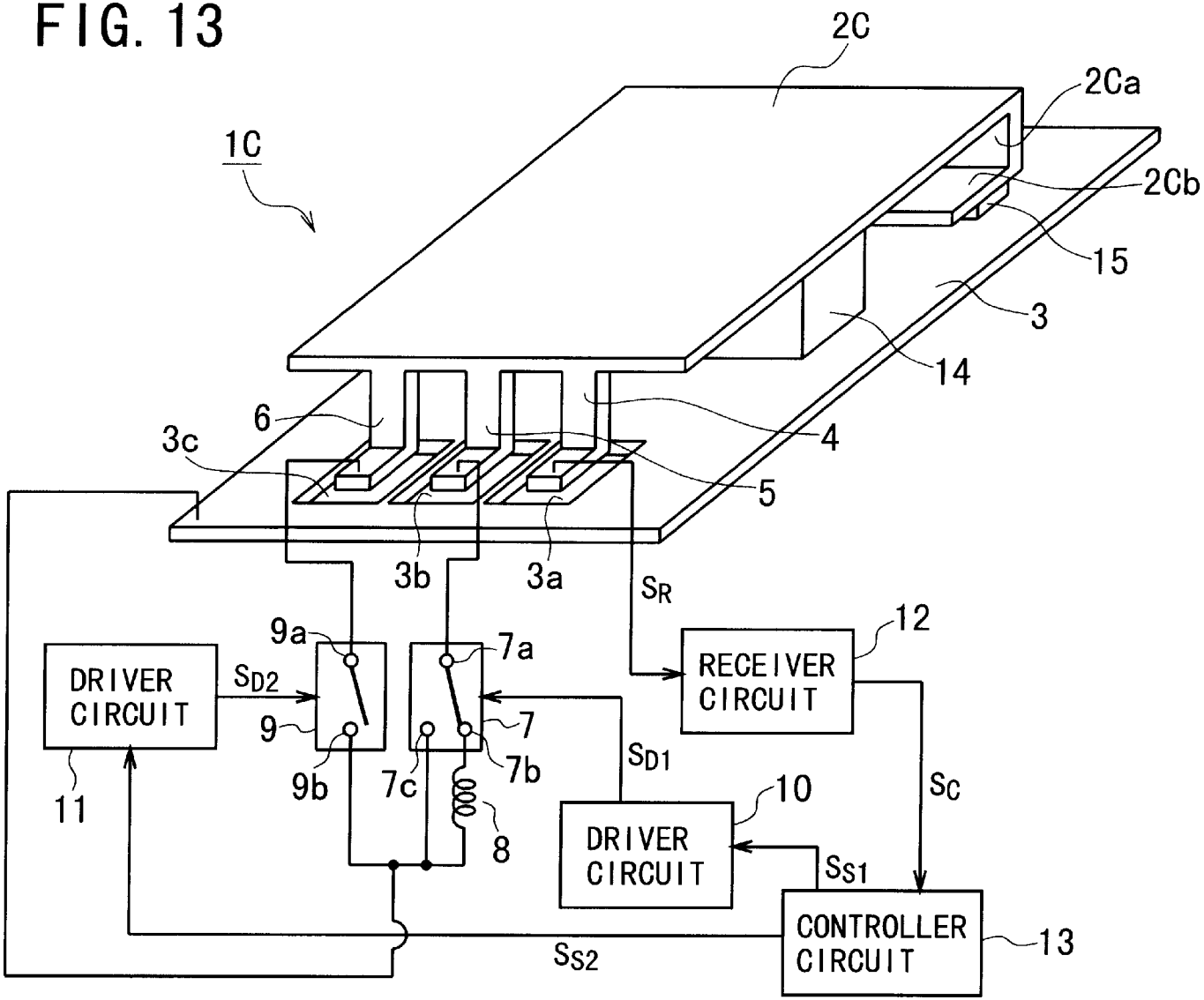
FIG. 13 is a schematic perspective view showing the configuration of an inverted-F antenna according to a fourth embodiment of the present invention, which is incorporated into a digital cellular phone.

FIG. 13 shows an inverted-F antenna 1C according to a fourth embodiment of the present invention, which is incorporated into a digital cellular phone having the same configuration as that explained in the first embodiment of FIG. 4.

The antenna 1C has the same configuration as that of the antenna 1 according to the first embodiment of FIG. 4 except that an opposite short-side of a rectangular plate-shaped radiating element 2C to the terminals 4, 5, and 6 has folded parts 2C*a* and 2C*b* and that a dielectric spacer 15 is provided between the part 2C*b* and the ground conductor 3. The part 2C*a* is perpendicular to the remaining flat part of the element 2C. The part 2C*b* is parallel to the remaining flat part of the element 2C. The parts 2C*a* and 2C*b* are formed by bending the end of the element 2C.

The part 2C*b* and the conductor 3 constitute a capacitor electrically linking the radiating element 2C with the ground conductor 3. Due to the capacitor thus inserted, there is an additional advantage that the resonart frequency of the antenna 1C is lowered without increasing the size of the antenna 1C.

Fifth Embodiment

Figure 17:
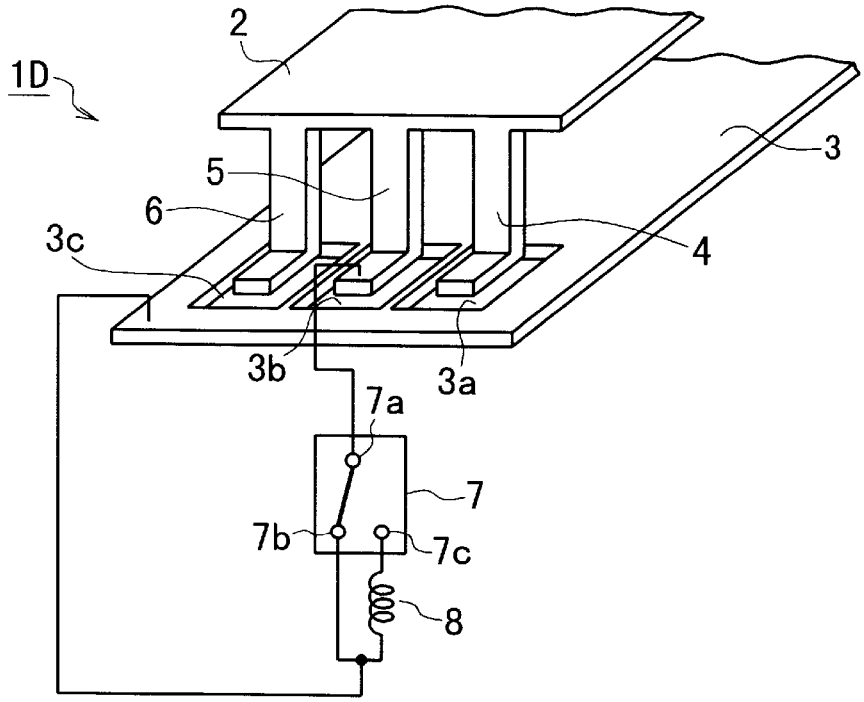
FIG. 17 is a schematic, partial perspective view showing the configuration of an inverted-F antenna according to a fifth embodiment of the present invention.

FIG. 17 shows an inverted-F antenna 1D according to a fifth embodiment of the present invention, which is incorporated into a digital cellular phone having the same configuration as that explained in the first embodiment of FIG. 4.

The antenna 1D, which is a variation of the antenna 1 according to the first embodiment of FIG. 4, has the same configuration as that of the antenna 1 except that the second switch 9 is canceled. Therefore, the second grounding terminal 6 is always inactive, i.e., the terminal 6 is always disconnected electrically from the ground conductor 3.

The antenna 1D is capable of operation in two separate frequency bands or a wide frequency band formed by overlapping these two bands. This antenna 1D can be changed to be operable in three separate frequencies by simply adding the second switch 9 without changing the structure of the radiating element 2, the ground conductor 3, and the three terminals 4, 5, and 6.

It is needless to say that the second grounding terminal 6 may be contacted with the ground conductor 3 by canceling the penetrating hole 3*c*, and that the second grounding terminal 6 itself may be canceled.

Sixth Embodiment

Figure 18:
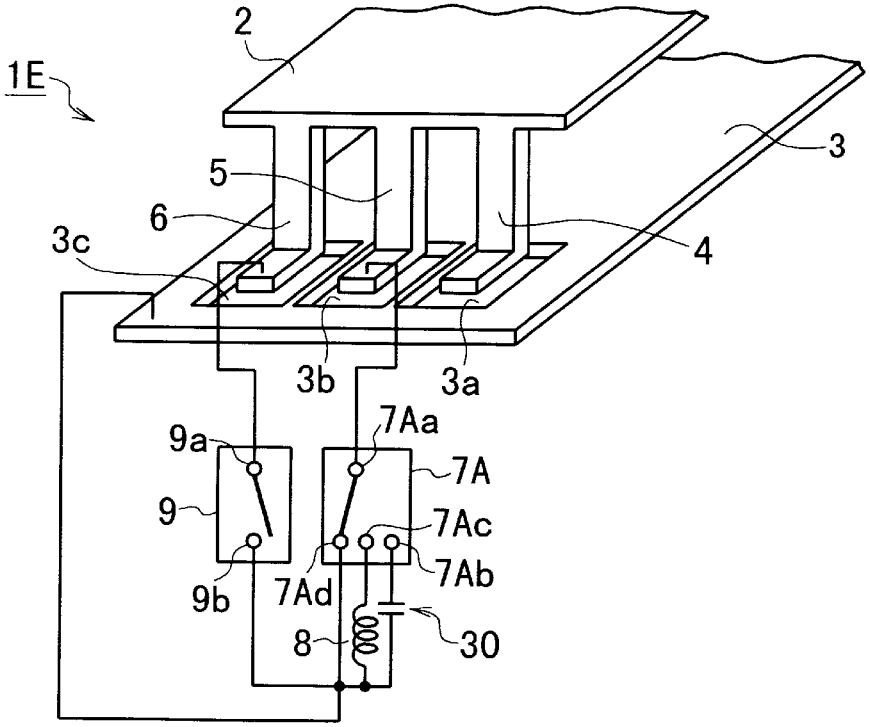
FIG. 18 is a schematic, partial perspective view showing the configuration of an inverted-F antenna according to a sixth embodiment of the present invention.

FIG. 18 shows an inverted-F antenna 1E according to a sixth embodiment of the present invention, which is incorporated into a digital cellular phone having the same configuration as that explained in the first embodiment of FIG. 4.

The antenna 1E, which is another variation of the antenna 1 according to the first embodiment of FIG. 4, has the same configuration as that of the antenna 1 except that a first switch 7A connected electrically to the first grounding terminal 5 is a three-way switch. The first grounding terminal 5 is electrically connected to a terminal 7A*a* of the first switch 7A. A terminal 7A*b* of the switch 7A is electrically connected to the ground conductor 3 through a capacitor 30.

A terminal 7A*c* of the switch 7A is electrically connected to the ground conductor 3 through the inductor 8. A terminal 7A*d* of the switch 7A is electrically connected directly to the ground conductor 3.

Therefore, the first grounding terminal 5 is selectively connected to the ground conductor 3 in three ways. Thus, the antenna 1D is capable of operation in four separate frequency bands or a wide frequency band formed by overlapping these four bands.

If the first ground terminal 5 is electrically connected to the ground conductor 3 through the capacitor 30, the resonant frequency of the antenna 1E is lowered. Therefore, there is an additional advantage that the resonant frequency of the antenna 1E can be raised or lowered by operating the first switch alone.

In the above-described first to sixth embodiments, two grounding terminals are provided. However, three or more grounding terminals may be provided with or without corresponding switches. Also, to increase the number of the operable frequencies of the antenna, any n-way switch may be used for each of the grounding terminals, where n is a natural number greater than two.

Although the feeding terminal and the first and second grounding terminals are electrically connected to one of the short-sides of the radiating element in the first to sixth embodiments, each of these terminals may be connected to the radiating element at its inner point.

The lower parts of the feeding terminal and the first and second grounding terminals are bent toward the opposite side to the radiating element in the first to sixth embodiments, they may be bent toward the same side as the radiating element.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. An inverted-F antenna comprising:

a radiating element for radiating or receiving an RF signal;

a ground conductor arranged to be opposite to said radiating element with a specific gap;

a feeding terminal electrically connected to said radiating element;

a first grounding terminal electrically connected to said radiating element;

at least one impedance element provided in a line connecting said first grounding terminal to said ground conductor; and a first switch for selectively inserting said at least one impedance element into said line;

wherein a resonant frequency of said antenna is changed by operating said first switch.

2. The antenna as claimed in claim 1, further comprising a second grounding terminal electrically connected to said radiating element.

3. The antenna as claimed in claim 1, further comprising a second grounding terminal electrically connected to said radiating element through a second switch.

4. The antenna as claimed in claim 1, wherein said impedance element comprises at least one of an inductance element and a capacitance element;

and wherein said first switch has a function of electrically connecting said first grounding terminal to said ground conductor through said at least one of said inductance element and said capacitance element and of electrically connecting said first grounding terminal to said ground conductor without said inductance element and said capacitance element.

5. The antenna as claimed in claim 1, wherein said first switch is a diode switch driven by a first driver circuit.

6. The antenna as claimed in claim 3, wherein said first switch is a diode switch driven by a first driver circuit and said second switch is a diode switch driven by a second driver circuit.

7. The antenna as claimed in claim 1, wherein said radiating element has a slit to increase the length of a current path.

8. The antenna as claimed in claim 1, wherein said radiating element has folded parts for forming an additional capacitance element between said radiating element and said ground conductor;

said additional capacitance element being electrically connected to link said radiating element with said ground conductor.

9. A radio communication system comprising;

(a) an inverted-F antenna including;

a radiating element for radiating or receiving an RF signal;

a ground conductor arranged to be opposite to said radiating element with a specific gap;

a feeding terminal electrically connected to said radiating element;

a first grounding terminal electrically connected to said radiating element;

at least one impedance element provided in a line connecting said first grounding terminal to said ground conductor;

a first switch for selectively inserting said at least one impedance element into said line;

a resonant frequency of said antenna being changed by operating said first switch;

(b) a receiver circuit for receiving said RF signal received by said antenna and for outputting a selection signal for selecting one of available frequency bands; and (c) a controller circuit for controlling an operation of said first switch by said selection signal.

10. The system as claimed in claim 9, wherein said resonant frequency of said antenna is selected so that power consumption of said system is minimized in a stand-by mode.

11. The system as claimed in claim 9, further comprising a first driver circuit for driving said first switch;

said first driver circuit supplying no driving current to said first switch in a stand-by mode.

* * * * *